US009038930B2

(12) United States Patent
Fukuta et al.

(10) Patent No.: US 9,038,930 B2
(45) Date of Patent: May 26, 2015

(54) FUEL INJECTION DEVICE

(75) Inventors: Yukihiro Fukuta, Kariya (JP); Tsukasa Yamashita, Kariya (JP)

(73) Assignee: DENSO CORPORATION, Kariya (JP)

( * ) Notice: Subject to any disclaimer, the term of this patent is extended or adjusted under 35 U.S.C. 154(b) by 1101 days.

(21) Appl. No.: 13/052,443

(22) Filed: Mar. 21, 2011

(65) Prior Publication Data

US 2011/0233309 A1 Sep. 29, 2011

(30) Foreign Application Priority Data

Mar. 24, 2010 (JP) ..... 2010-68806

(51) Int. Cl.
*F02M 47/02* (2006.01)

(52) U.S. Cl.
CPC ..... *F02M 47/027* (2013.01)

(58) Field of Classification Search
CPC .. F02M 47/022; F02M 47/025; F02M 47/027
USPC ..... 239/88, 124, 533.2, 96, 585.1; 123/457, 123/467, 514, 518
See application file for complete search history.

(56) References Cited

U.S. PATENT DOCUMENTS

| | | | | |
|---|---|---|---|---|
| 4,826,080 | A * | 5/1989 | Ganser | 239/88 |
| 6,092,737 | A * | 7/2000 | Bosch et al. | 239/96 |
| 6,892,955 | B2 * | 5/2005 | Grabandt | 239/88 |
| 2012/0175435 | A1 | 7/2012 | Yamashita et al. | |

FOREIGN PATENT DOCUMENTS

| | | | | |
|---|---|---|---|---|
| WO | WO 2005/019637 | | 3/2005 | |
| WO | WO2005019637 | * | 3/2005 | F02M 45/08 |

OTHER PUBLICATIONS

Office Action (9 pages) dated Dec. 3, 2012 in corresponding Chinese Application No. 201110078483.3 and English translation (9 pages).
Office Action (8 pages) dated May 23, 2013, issued in copending U.S. Appl. No. 13/343,126 of Yamashita, filed Jan. 4, 2012.

* cited by examiner

*Primary Examiner* — Len Tran
*Assistant Examiner* — Joel Zhou
(74) *Attorney, Agent, or Firm* — Nixon and Vanderhye P.C.

(57) ABSTRACT

In a fuel injection device, a pressing surface of a pressing member presses an opening wall surface to interrupt communication between an inflow port and a pressure control chamber when communication between an outflow port and a return channel is made by a pressure control valve, and the pressing surface of the pressing member is displaced and separated from the opening wall surface to open the inflow port of the opening wall surface to the pressure control chamber when the communication between the outflow port and the return channel is interrupted by the pressure control valve. One of the pressing surface of the pressing member and the opening wall surface of the control body is provided with an inflow depressed portion and an outflow depressed portion partitioned from each other, and a depressed dimension of the inflow depressed portion is larger than a depressed dimension of the outflow depressed portion.

8 Claims, 6 Drawing Sheets

FUEL INJECTION DEVICE

CROSS REFERENCE TO RELATED APPLICATION

This application is based on Japanese Patent Application No. 2010-068806 filed on Mar. 24, 2010, the contents of which are incorporated herein by reference in its entirety.

FIELD OF THE INVENTION

The present invention relates to a fuel injection device that opens and closes a valve portion to control an injection of supply fuel supplied form a supply channel, and that discharges a portion of the supply fuel to a return channel based on the control.

BACKGROUND OF THE INVENTION

There has been known a fuel injection device including a control body, which has a pressure control chamber, and a valve member for opening and closing a valve portion in response to the pressure of fuel in the pressure control chamber. In the fuel injection device, the pressure control chamber of the control body has an inflow port and an outflow port opened therein. The inflow port is a port through which fuel flowing through a supply channel flows into the pressure control chamber, and the outflow port is a port through which the fuel is discharged to a return channel. The pressure of the fuel in the pressure control chamber is controlled by a pressure control valve for making communication between the outflow port and the return channel and for interrupting the communication between them.

In a fuel injection device disclosed in patent document 1 (JP 6-108948A corresponding to U.S. Pat. No. 4,826,080), a pressing member is further provided in a pressure control chamber, to be reciprocally displaced in the pressure control chamber. When the outflow port is made to communicate with the return channel by the pressure control valve, the pressing member is drawn to the opening wall surface having the outflow port opened therein by a reduce of the fuel pressure near the outflow port, thereby pressing the opening wall surface by the pressing member. When the opening wall surface is pressed by the pressing member, the pressing member interrupts the communication between the inflow port and the pressure control chamber, and the outflow port. In addition, when the pressure control valve interrupts the outflow port and the return channel, the pressing member is pressed by the high-pressure supply fuel supplied from the supply channel via the inflow port, and displaces in a direction separated from the opening wall surface. By the displacement of the pressing member, the inflow port and the pressure control chamber are made to communicate with each other.

SUMMARY OF THE INVENTION

The inventors of the present application studied about a fuel injection device in order to accurately shut a fuel communication between the pressing surface of the pressing member and the opening wall surface. That is, the inventors of the present application studied regarding a structure for increasing the surface pressure of the abutting portion by reducing an abutting area between the pressing surface and the opening wall surface. Specifically, an outflow depressed portion and an inflow depressed portion are formed on the opening wall surface or the pressing surface, thereby reducing the abutting area between the opening wall surface and the pressing surface.

However, when the outflow depressed portion and the inflow depressed portion are simply formed, it may be difficult to improve a responsibility of the valve portion and durability of the fuel injection device.

The present invention is made in view of the above matters, and it is an object of the present invention to provide a fuel injection device, which can improve the responsibility of a valve portion while improving durability in the fuel injection device.

According to an aspect of the present invention, a fuel injection device is adapted to open and close a valve portion for controlling an injection of supply fuel supplied from a supply channel and injected from a nozzle hole, and to discharge a portion of the supply fuel into a return channel based on the control. The fuel injection device includes: a control body having a pressure control chamber, into which the fuel flowing through the supply channel flows from an inflow port and from which the fuel is discharged to the return channel through an outflow port, and an opening wall surface exposed to the pressure control chamber and having the inflow port and the outflow port opened therein; a pressure control valve configured to make communication between the outflow port and the return channel and to interrupt the communication, so as to control pressure of the fuel in the pressure control chamber; a valve member configured to open and close the valve portion in response to the pressure of the fuel in the pressure control chamber; and a pressing member arranged to be reciprocally displaced in the pressure control chamber and having a pressing surface opposite to the opening wall surface. The pressing surface of the pressing member presses the opening wall surface to interrupt communication between the inflow port and the pressure control chamber when the communication between the outflow port and the return channel is made by the pressure control valve, and the pressing surface of the pressing member is displaced and separated from the opening wall surface to open the inflow port of the opening wall surface to the pressure control chamber when the communication between the outflow port and the return channel is interrupted by the pressure control valve. The opening wall surface has an outflow peripheral surface portion provided around the outflow port, and an inflow peripheral surface portion provided around the inflow port. The pressing surface of the pressing member is provided with an outflow-opposite surface portion opposite to the outflow peripheral surface portion in a displacement axis direction, and an inflow-opposite surface portion opposite to the inflow peripheral surface portion in the displacement axis direction.

In the fuel injection device, one of the outflow peripheral surface portion and the outflow-opposite surface portion of the opening wall surface and the pressing surface is provided with an outflow depressed portion depressed in the displacement axis direction to a side opposite to the other one of the outflow peripheral surface portion and the outflow-opposite surface portion, and one of the inflow peripheral surface portion and the inflow-opposite surface portion of the opening wall surface and the pressing surface, which is provided with the outflow depressed portion, is provided with an inflow depressed portion depressed in the displacement axis direction to a side opposite to the other one of the inflow peripheral surface portion and the inflow-opposite surface portion. Furthermore, a depressed dimension of the inflow depressed portion is larger than a depressed dimension of the outflow depressed portion, in the displacement axis direction. Accordingly, even when pressure in the inflow depressed portion is different from the pressure in the outflow depressed portion and the pressure different is applied to a partition wall between the inflow depressed portion and the outflow depressed portion, it is possible to increase the strength of the partition wall, thereby increasing the durability in the fuel injection device. In addition, because the depressed dimension of the inflow depressed portion is made larger, the amount of the supply fuel stored in the inflow depressed portion can be increased, and thereby the fuel amount discharged from the inflow depressed portion to the pressure control chamber can be increased when the communication between the outflow port and the return channel is shut by the pressure control valve. Thus, the fuel pressure in the pressure control chamber can be rapidly recovered, and thereby the nozzle needle accurately closes the valve portion in accordance with the fuel pressure in the pressure control chamber. As a result, the responsibility of the fuel injection device can be improved.

For example, the pressing surface of the pressing member may be a circular shape, and the inflow depressed portion may be a circular shape provided coaxially with the pressing surface. In this case, the inflow depressed portion may be provided such that the fuel flows in a circumferential direction, and a channel sectional area of the inflow depressed portion may be larger than the half of an open area of the inflow port.

The inflow depressed portion may be provided at an outer peripheral side of the outflow depressed portion in the opening wall surface or the pressing surface. Furthermore, the control body may include a channel forming body that is provided with the opening wall surface and defines the pressure control chamber, and the inflow peripheral surface portion and the outflow peripheral surface portion may define respectively the inflow depressed portion and the outflow depressed portion.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

Figure 1:
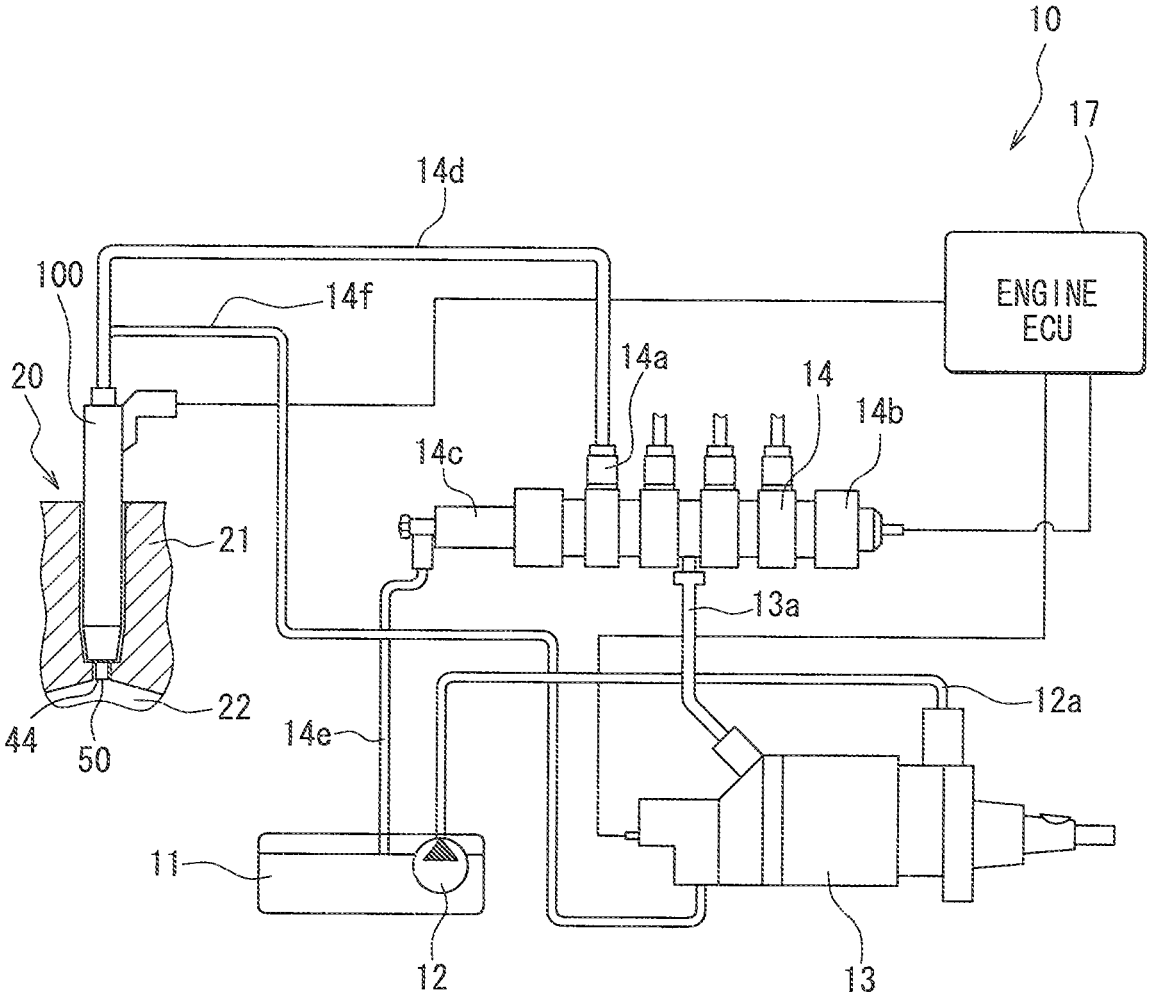
FIG. 1 is a schematic diagram of a fuel supply system having a fuel injection device according to a first embodiment of the present invention.

Embodiments of the present invention will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A fuel supply system 10, in which a fuel injection device 100 according to a first embodiment of the present invention is used, is shown in FIG. 1. The fuel injection device 100 of the present embodiment is a so-called direct injection fuel supply system in which fuel is directly injected into a combustion chamber 22 of a diesel engine 20 as an internal combustion engine.

The fuel supply system 10 is constructed of a feed pump 12, a high-pressure fuel pump 13, a common rail 14, an engine control device 17 (engine ECU), the fuel injection device 100, and the like.

The feed pump 12 is an electrically driven pump and is housed in a fuel tank 11. The feed pump 12 applies a feed pressure to fuel stored in the fuel tank 11, such that the feed pressure is higher than the vapor pressure of the fuel. The feed pump 12 is connected to the high-pressure fuel pump 13 with a fuel pipe 12*a* and supplies the liquid-state fuel, which has a predetermined feed pressure applied thereto, to the high-pressure fuel pump 13. The fuel pipe 12*a* has a pressure control valve (not shown) fitted thereto and the pressure of the fuel supplied to the high-pressure fuel pump 13 is held at a specified value by the pressure control valve.

The high-pressure fuel pump 13 is attached to the diesel engine 20 and is driven by power from an output shaft of the diesel engine 20. The high-pressure fuel pump 13 is connected to the common rail 14 by a fuel pipe 13*a*, and further applies pressure to the fuel supplied by the feed pump 12 to supply the fuel to the common rail 14. In addition, the high-pressure fuel pump 13 has an electromagnetic valve (not shown) electrically connected to the engine control device 17. The electromagnetic valve is opened or closed by the engine control device 17, and thereby the pressure of the fuel supplied from the high-pressure fuel pump 13 to the common rail 14 is optimally controlled to a predetermined pressure.

The common rail 14 is a pipe-shaped member made of a metal material such as chromium molybdenum steel and has a plurality of branch parts 14*a*. The number of the plurality of branch parts 14 corresponds to the number of cylinders per bank of the diesel engine. Each of the branch parts 14*a* is connected to the fuel injection device 100 by a fuel pipe forming a supply channel 14*d*. The fuel injection device 100 and the high-pressure fuel pump 13 are connected to each other by a fuel pipe forming a return channel 14*f*. According to the above-mentioned construction, the common rail 14 temporarily stores the fuel supplied in a high-pressure state by the high-pressure fuel pump 13, and distributes the fuel to the plurality of fuel injection devices 100 with the pressure held in the high-pressure state through the supply channels 14*d*. In addition, the common rail 14 has a common rail sensor 14*b* provided at one end portion of both end portions in an axial direction, and has a pressure regulator 14*c* provided at the other end portion thereof. The common rail sensor 14*b* is electrically connected to the engine control device 17 and detects the pressure and the temperature of the fuel and outputs them to the engine control device 17. The pressure regulator 14*c* maintains the pressure of the fuel in the common rail 14 at a constant value, and decompresses and discharge excess fuel. The excess fuel passing through the pressure regulator 14*c* is returned to the fuel tank 11 through a channel in a fuel pipe 14*e* that connects the common rail 14 to the fuel tank 11.

The fuel injection device 100 is a device for injecting high-pressure supply fuel supplied through the branch part 14*a* of the common rail 14, from a nozzle hole 44. Specifically, the fuel injection device 100 has a valve portion 50 that controls the injection of the supply fuel injected from the nozzle hole 44 according to a control signal from the engine control device 17. The supply fuel is supplied from the high-pressure pump 13 through the supply channel 14*d*. In addition, in the fuel injection device 100, the excess fuel, which is a portion of the supply fuel supplied from the supply channel 14*d* and is not injected from the nozzle hole 44, is discharged into the return channel 14*f* through which the fuel injection device 100 communicates with the high-pressure fuel pump 13, and then is returned to the high-pressure fuel pump 13. The fuel injection device 100 is inserted into and fitted into an insertion hole made in a head member 21 that is a portion of the combustion chamber 22 of the diesel engine 20. In the present embodiment, a plurality of the fuel injection devices 100 are arranged respectively for the combustion chamber 22 of the diesel engine 20 and each of them injects the fuel directly into the combustion chamber 22, specifically, with an injection pressure of a range from 160 to 220 megapascal (MPa). The engine control device 17 is constructed of a microcomputer or the like.

The engine control device 17 is electrically connected to not only the common rail sensor 14*b* described above but also various kinds of sensors such as a rotational speed sensor for detecting the rotational speed of the diesel engine 20, a throttle sensor for detecting a throttle opening, an air flow sensor for detecting an intake air volume, a boost pressure sensor for detecting a boost pressure, a water temperature sensor for detecting a cooling water temperature, and an oil temperature sensor for detecting the oil temperature of lubricating oil. The engine control device 17 outputs an electric signal for controlling the opening/closing of the electromagnetic valve of the high-pressure fuel pump 13 and the valve portion 50 of each fuel injection device 100, to the electromagnetic valve of the high-pressure fuel pump 13 and to each fuel injection device 100 on the basis of information from these respective sensors.

Next, the structure of the fuel injection device 100 will be described in detail on the basis of FIG. 2 and FIG. 3.

The fuel injection device 100 includes a control valve driving part 30, a control body 40, a nozzle needle 60 and a floating plate 70.

The control valve driving part 30 is housed in the control body 40. The control valve driving part 30 includes a terminal 32, a solenoid 31, a fixed member 36, a movable member 35, a spring 34, and a valve seat member 33. The terminal 32 is formed of a metal material having electrical conductivity and has one end portion of both end portions in an extending direction exposed to the outside from the control body 40 and has the other end portion thereof connected to the solenoid 31. The solenoid 31 is spirally wound and is supplied with a pulse current from the engine control device 17 via the terminal 32. When the solenoid 31 is supplied with this current, the solenoid 31 generates a magnetic field circling along the axial direction. The fixed member 36 is a cylindrical member formed of a magnetic material and is magnetized in the magnetic field generated by the solenoid 31. The movable member 35 is a member formed of a magnetic material and in the shape of a cylinder having two steps and is arranged on a tip side in the axial direction of the fixed member 36. The movable member 35 is attracted to a base end side in the axial direction by the magnetized fixed member 36. The spring 34 is a coil spring made by winding a metal wire in the shape of a circle and biases the movable member 35 in a direction to separate the movable member 35 from the fixed member 36. The valve seat member 33 configures a pressure control valve 80 together with a control valve seat portion 47*a* of the control body 40. The control valve seat portion 47*a* will be described later. The valve seat member 33 is arranged on the opposite side of the fixed member 36 in the axial direction of the movable member 35, and is seated on the control valve seat portion 47*a*. When the magnetic field is not generated by the solenoid 31, the valve seat member 33 is seated on the control valve seat portion 47*a* by the biasing force of the spring 34. When the magnetic field is generated by the solenoid 31, the valve seat member 33 is separated from the control valve seat portion 47*a*.

The control body 40 has a nozzle body 41, a cylinder 56, an orifice plate 46, a holder 48, and a retaining nut 49. The nozzle body 41, the orifice plate 46, and the holder 48 are arranged in this order from a tip side in a direction in which they are inserted into the head member 21 having the nozzle hole 44 formed therein (see FIG. 1). The control body 40 has an inflow channel 52, an outflow channel 54, a pressure control chamber 53, and an opening wall surface 90 (abutting surface) that is exposed to the pressure control chamber 53 to define the pressure control chamber 53. The inflow channel 52 communicates with a side of the supply channel 14*d* (see FIG. 1) connected to the high-pressure fuel pump 13 and the common rail 14, and has an inflow port 52*a* opened at the opening wall surface 90. The inflow port 52*a* is a channel end of the inflow channel 52. The outflow channel 54 communicates with a side of the return channel 14*f* (see FIG. 1) connected to the high-pressure fuel pump 13, and has an outflow port 54*a* opened at the opening wall surface 90. The outflow port 54*a* is a channel end of the outflow channel 54. The pressure control chamber 53 is partitioned by the cylinder 56 and the like, and the fuel passing through the supply channel 14*d* (see FIG. 1) flows into the pressure control chamber 53 from the inflow port 52*a* and flows out of the pressure control chamber 53 to the return channel 141 (see FIG. 1) from the outflow port 54*a*.

The nozzle body 41 is a member made of a metal material such as chromium molybdenum steel or the like in the shape of a circular cylinder and closed at one end. The nozzle body 41 has a nozzle needle housing portion 43, a valve seat portion 45, and the nozzle hole 44. The nozzle needle housing portion 43 is formed along the axial direction of the nozzle body 41, and is a cylindrical hole in which a nozzle needle 60 is housed. The nozzle needle housing portion 43 has high-pressure fuel that is supplied from the high-pressure fuel pump 13 and the common rail 14 (see FIG. 1). The valve seat portion 45 is formed on the bottom wall of the nozzle needle housing portion 43 and is brought into contact with the tip end of the nozzle needle 60. The nozzle hole 44 is located on the opposite side of the orifice plate 46 with respect to the valve seat portion 45. A plurality of the nozzle holes 44 are formed radially from the inside of the nozzle body 41 to the outside thereof. When the high-pressure fuel passes through the nozzle holes 44, the high-pressure fuel is atomized and diffused, thereby being brought into a state where the fuel is easily mixed with air.

The cylinder 56 made of a metal material forms a cylindrical wall portion that is formed in the shape of a circular cylinder and that defines the pressure control chamber 53 together with the orifice plate 46 and the nozzle needle 60. The cylinder 56 is a member made of a metal material in the shape of a circular cylinder, and is arranged coaxially with the nozzle needle housing portion 43 within the nozzle needle housing portion 43. In the cylinder 56, an end surface located on a side of the orifice plate 46 in the axial direction is held by the orifice plate 46.

The cylinder 56 is provided with an inner wall surface which defines a control wall surface portion 57, a cylinder sliding portion 59, a plate stopper portion 58*a* and a needle stopper portion 58*b*. The control wall surface portion 57 is positioned on a side of the orifice plate 46 in an axial direction of the cylinder 56, and circularly encloses the opening wall surface 90 to define the pressure control chamber 53. The cylinder sliding portion 59 is positioned on a side opposite to the orifice plate 46 in the axial direction of the cylinder 56, such that the nozzle needle 60 is slidable along the axial direction. The inner diameter of the cylinder sliding portion 59 is reduced with respect to the inner diameter of the control wall surface 57, so that a step portion used as a plate stopper portion 58*a* is formed between the control wall surface portion 57 and the cylinder sliding portion 59. Because the plate stopper portion 58*a* is formed by the step portion using the difference of the inner diameters between the cylinder sliding portion 59 and the control wall surface portion 57, the plate stopper portion 58*a* has a stopper surface facing the floating plate 70 in a displacement axis direction on which the floating plate 70 displaces. The plate stopper portion 58*a* is configured to regulate the displacement of the floating plate 70 in the direction approaching the nozzle needle 60. The needle stopper portion 58*b* is formed in the cylinder sliding portion 59 on a side opposite to the control wall surface portion 57 in the axial direction (displacement axis direction). The needle stopper portion 58*b* is configured to regulate the displacement of the nozzle needle 60 in the direction approaching the floating plate 70. Thus, the needle stopper portion 58*b* has a stopper surface facing to a direction opposite to the stopper surface of the plate stopper portion 58*a* in the axial direction.

The orifice plate 46 is a member made of a metal material such as chromium molybdenum steel in the shape of a circular column, and is held between the nozzle body 41 and the holder 48. The orifice plate 46 has a control valve seat portion 47*a*, the opening wall surface 90, the outflow channel 54, and the inflow channel 52. The control valve seat portion 47*a* is formed on one end surface of the orifice plate 46 on a side of the holder 48 in the axial direction of the orifice plate 46, and constructs the pressure control valve 80 together with the valve seat member 33 of the control valve driving part 30 and the like. The opening wall surface 90 is a flat surface formed in a central portion in the radial direction of an end surface of the orifice plate 46 on a side of the nozzle body 41. The opening wall surface 90 is surrounded by the cylindrical cylinder 56 and is formed in a circular shape. The outflow channel 54 is extended toward the control valve seat portion 47*a* from a central portion in the radial direction of the opening wall surface 90. The outflow channel 54 is inclined with respect to the axial direction of the orifice plate 46. The inflow channel 52 is extended toward an end surface forming the control valve seat portion 47*a* from the outside in the radial direction of the outflow channel 54 in the opening wall surface 90. The inflow channel 52 is inclined with respect to the axial direction of the orifice plate 46.

The holder 48 is a member made of a metal material such as chromium molybdenum steel in the shape of a cylinder, and has longitudinal holes 48*a*, 48*b* formed along the axial direction and has a socket portion 48*c*. The longitudinal hole 48*a* is a fuel channel that makes the supply channel 14*d* (see FIG. 1) communicate with the inflow channel 52. On the other hand, the longitudinal hole 48*b* has therein the control valve driving part 30 on a side of the orifice plate 46. In addition, in the longitudinal hole 48*b*, the socket portion 48*c* is formed at a portion on the opposite side of the orifice plate 46, in such a way as to close the opening of the longitudinal hole 48*b*. The socket portion 48*c* has one end of the terminal 32 of the control valve driving part 30 projected thereinto and has a plug portion (not shown) detachably fitted therein. The plug portion is connected to the engine control device 17. When the socket portion 48*c* is connected to the plug portion (not shown), a pulse current can be supplied to the control valve driving part 30 from the engine control device 17.

The retaining nut 49 is a member made of a metal material in the shape of a circular cylinder having two steps. The retaining nut 49 houses a portion of the nozzle body 41 and the orifice plate 46, and is screwed with a portion of the holder 48 on a side of the orifice plate 46. In addition, the retaining nut 49 has a stepped portion 49*a* on the inner peripheral wall portion thereof. When the retaining nut 49 is fitted to the holder 48, the stepped portion 49*a* presses the nozzle body 41 and the orifice plate 46 toward the holder 48. In this manner, the retaining nut 49 holds the nozzle body 41 and the orifice plate 46, together with the holder 48.

Figure 2:
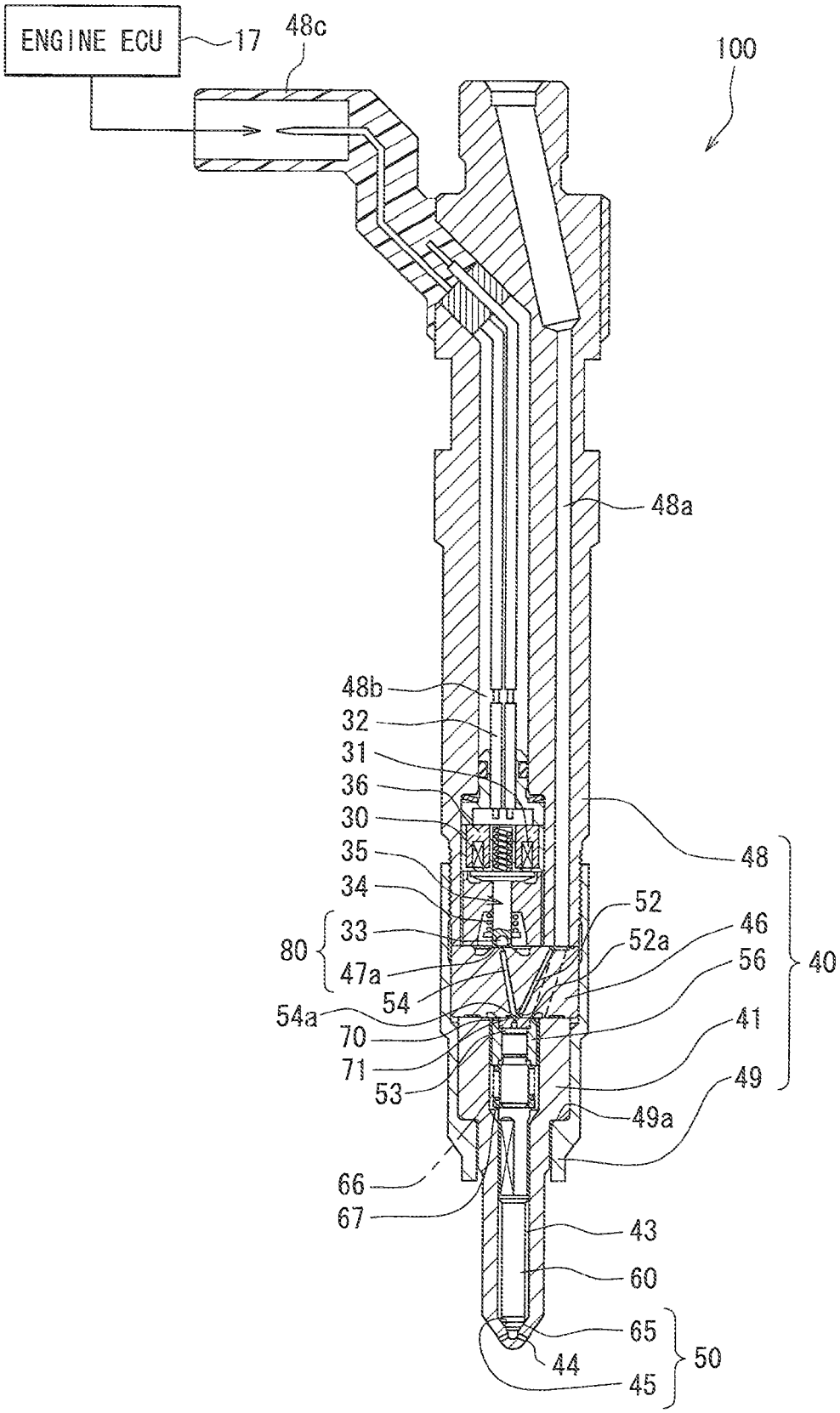
FIG. 2 is a longitudinal section view of the fuel injection device according to the first embodiment of the present invention.
Figure 3:
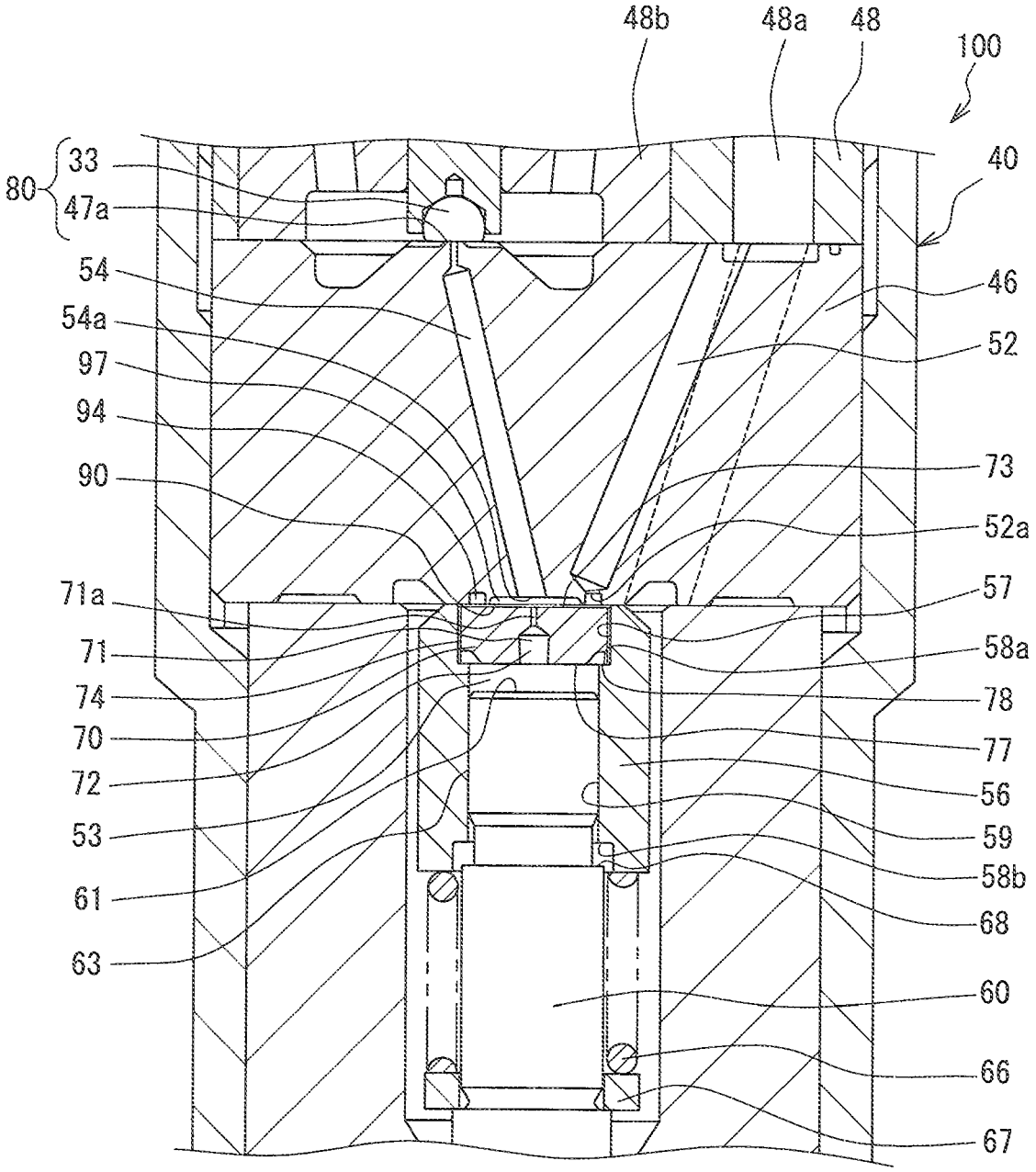
FIG. 3 is a partially enlarged view showing a portion of the fuel injection device according to the first embodiment of the present invention.

The nozzle needle 60 is formed of a metal material such as high-speed tool steel in the shape of a circular column as a whole, and has a seat portion 65, a pressure receiving surface 61, a needle sliding portion 63, a needle engagement portion 68, a return spring 66 and a collar member 67, as shown in FIGS. 2 and 3. The seat portion 65 is formed on an end portion, which is one of both end portions in the axial direction of the nozzle needle 60 and is arranged opposite to the pressure control chamber 53, and is seated on the valve seat portion 45 of the control body 40. The seat portion 65 constructs a valve portion 50 together with the valve seat portion 45, such that the valve portion 50 allows and interrupts the flow of the high-pressure fuel supplied into the nozzle needle housing portion 43 to the nozzle holes 44. The pressure receiving surface 61 is formed of an end portion, which is one of both end portions in the axial direction of the nozzle needle 60, and is arranged at a side of the pressure control chamber 53, opposite to the seat portion 65. The pressure receiving surface 61 partitions the pressure control chamber 53 together with the opening wall surface 90 and the control wall surface portion 57, and receives the pressure of the fuel in the pressure control chamber 53.

The needle sliding portion 63 is a portion of the circular column-shaped outer peripheral wall of the nozzle needle 60 and is located closer to the pressure receiving surface 61 than the control wall surface portion 57. The needle sliding portion 63 is supported in such a way as to freely slide with respect to the cylinder sliding portion 59 formed by the inner peripheral wall of the cylinder 56. The collar member 67 is a ring-shaped member fitted on the outer peripheral wall portion of the nozzle needle 60 and is held by the nozzle needle 60. The needle engagement portion 68 is formed by a step portion that is formed by enlarging the outer diameter of the nozzle needle 60. The needle engagement portion 68 is positioned at a side of the seat portion 65, more than the position of the needle sliding surface 63 in the axial direction. The needle engagement portion 68 is provided with a surface facing the needle stopper portion 58*b* of the cylinder 56 in the axial direction of the nozzle needle 60. The needle engagement portion 68 is engaged with the needle stopper portion 58*b*, so that the displacement of the nozzle needle 60 in the direction approaching the floating plate 70 can be regulated.

The nozzle needle 60 is biased to a side of the valve portion 50 by a return spring 66. The return spring 66 is a coil spring made by winding a metal wire in the shape of a circle. The return spring 66 has one end in the axial direction seated on a face of the collar member 67 on a side of the pressure control chamber 53 and has the other end seated on an end surface of the cylinder 56 on the valve portion side, respectively. According to the construction described above, the nozzle needle 60 is reciprocally displaced in a linear manner in the axial direction of the cylinder 56 with respect to the cylinder 56 in response to the pressure applied to the pressure receiving surface 61, that is, the pressure of the fuel in the pressure control chamber 53, so that the seat portion 65 seats on the valve seat portion 45 or the seat portion 65 is separated from the valve seat portion 45, thereby closing or opening the valve portion 50.

The floating plate 70 is a member made of a metal material in the shape of a circular disk and has a pressing surface 73, a pressure receiving surface 77, a plate engagement portion 78, an outer peripheral wall surface 74 and a flow restricting hole 71. In addition, the floating plate 70 is arranged coaxially with the cylinder 56, to be reciprocated in the pressure control chamber 53 in the axial direction. The floating plate 70 is arranged in such a way to be reciprocally displaced in the pressure control chamber 53 and has its displacement axis direction arranged along the axial direction of the cylinder 56. Of both end surfaces in the displacement axis direction of the floating plate 70, the end surface opposite to the opening wall surface 90 in the displacement axis direction forms the pressing surface 73. When the floating plate 70 is reciprocally displaced, the pressing surface 73 abuts on the opening wall surface 90 (abutting surface). The other axial end surface of the floating plate 70, opposite to the pressing surface 73, is adapted as the pressure receiving, surface 77 that is opposite to the pressure receiving surface 61 of the nozzle needle 60 in the axial direction. The pressure receiving surface 77 of the floating plate 70 receives a force in a direction toward the opening wall surface 90, by the fuel pressure in the pressure control chamber 53. The plate engagement portion 78 is provided at an outer peripheral portion of the pressure receiving surface 77, to be opposite to the plate stopper portion 58*a* of the cylinder 56 in the axial direction. The plate engagement portion 78 is engaged with the plate stopper portion 58*a*, so as to regulate the displacement of the floating plate 70 in the direction approaching the nozzle needle 60.

The outer peripheral wall surface 74 of the floating plate 70 is provided in a cylindrical shape to connect the pressing surface 73 and the pressure receiving surface 77 that are positioned at two end sides of the floating plate 70 in the displacement axis direction. The outer peripheral wall surface 74 of the floating plate 70 is opposite to the control wall surface portion 57 in a radial direction perpendicular to the displacement axis direction. In a state where the floating plate 70 is placed coaxially with respect to the cylinder 56, a clearance is provided between the outer peripheral wall surface 74 of the floating plate 70 and the control wall surface portion 57, so that the fuel can flow in the clearance. The fuel flowing into a space of the pressure control chamber 53 between the pressing surface 73 of the floating plate 70 and the opening wall surface 90, flows into a space of the pressure control chamber 53 between the pressure receiving surface 77 of the floating plate 70 and the pressure receiving surface 61, via the clearance between the outer peripheral wall surface 74 and the control wall surface portion 57.

The flow restricting hole 71 is provided in the floating plate 70 to extend from a center portion in the radial direction of the pressure receiving surface 77 of the floating plate 70 to a center portion in the radial direction of the pressing surface 73 of the floating plate 70. The flow restricting hole 71 is made to communicate with the outflow port 54*a* of the outflow channel 54. The flow restricting hole 71 is extended in the central portion of the floating plate 70, along the displacement axis direction of the floating plate 70. The flow restricting hole 71 is open at the center portion of the pressing surface 73, toward the outflow port 54*a* of the outflow channel 54. When the pressing surface 73 of the floating plate 70 contacts the opening wall surface 90, the pressure control chamber 53 communicates with the outflow port 54*a* via the flow restricting hole 71, such that a flow amount of the fuel from the pressure control chamber 53 to the outflow port 54*a* of the outflow channel 54 is controlled and restricted.

The flow restricting hole 71 has a throttle portion 71*a* and a communication depressed portion 72. The throttle portion 71*a* narrows the channel area of the flow restricting hole 71 to regulate the flow amount of the fuel flowing through the flow restricting hole 71. The cannel area of the throttle portion 71*a* is smaller than the open area of the outflow port 54*a* of the outflow channel 54. The throttle portion 71*a* is positioned in an area closer to the pressing surface 73, which is one of both end surfaces in the axial direction of the floating plate 70, than the position the pressure receiving surface 77. The communication depressed portion 72 is a cylindrical hole formed coaxially with the floating plate 70. The depressed portion 72 is depressed from the pressure receiving surface 77 in the floating plate 70 such that the passage area of the flow restricting hole 71 is partially enlarged. By forming the depressed portion 72, the opening area of the flow restricting hole 71 opened at the pressure receiving surface 77 is enlarged.

Figure 4:
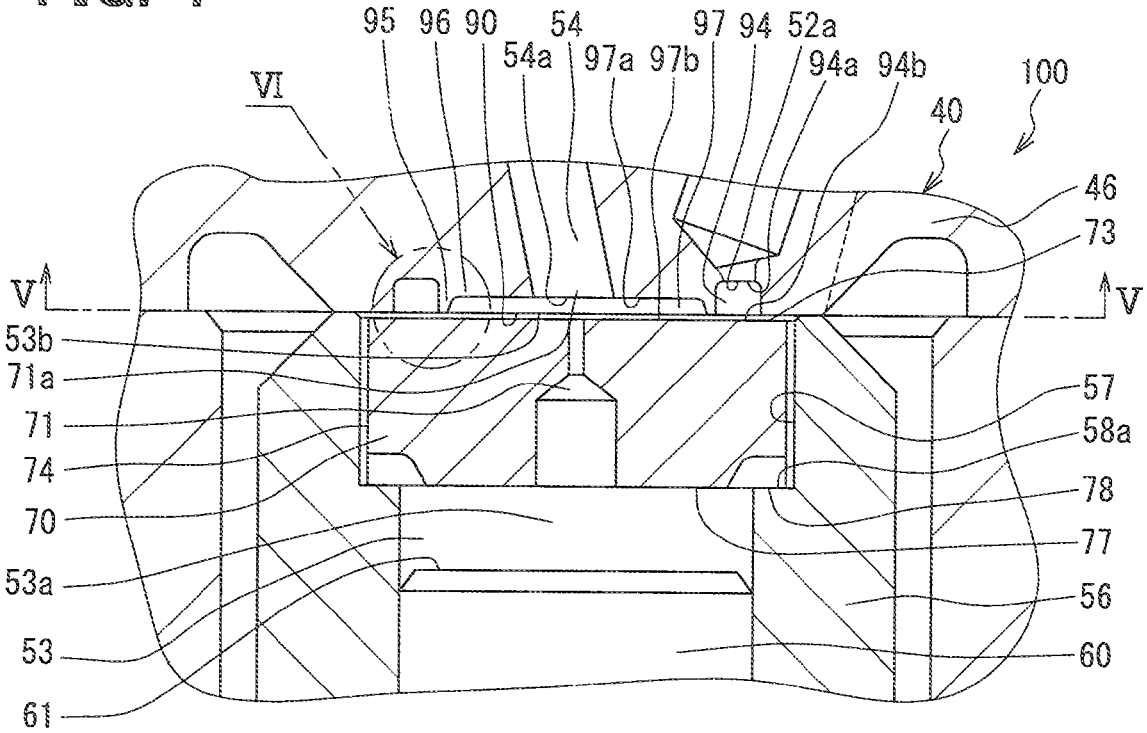
FIG. 4 is a further enlarged view showing the portion of the fuel injection device according to the first embodiment of the present invention.

As shown in FIG. 4, the floating plate 70 is arranged in the pressure control chamber 53, to divide the pressure control chamber 53 into an opening space 53*a* and a back pressure space 53*b*. The opening space 53*a* is space provided between the pressure receiving surface 77 of the floating plate 70 and the pressure receiving surface 61 of the nozzle needle 60. That is, the opening space 53*a* is a provided opposite to the pressing surface 73 in the displacement axis direction with respect to the floating plate 70. The back pressure space 53*b* is a space provided between the opening wall surface 90 and the pressing surface 73 of the floating plate 70. That is, the back pressure space 53*b* is provided opposite to the pressure receiving surface 77 in the displacement axis direction with respect to the floating plate 70.

Figure 5:
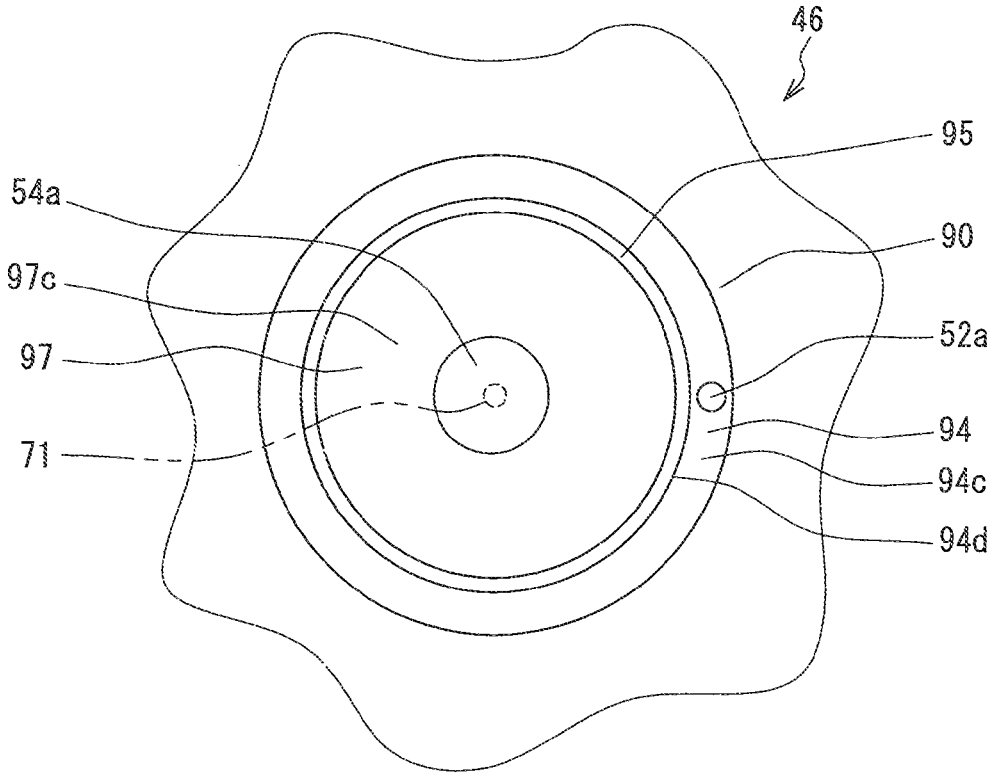
FIG. 5 is a cross-sectional view taken along the line V-V of FIG. 4.
Figure 6:
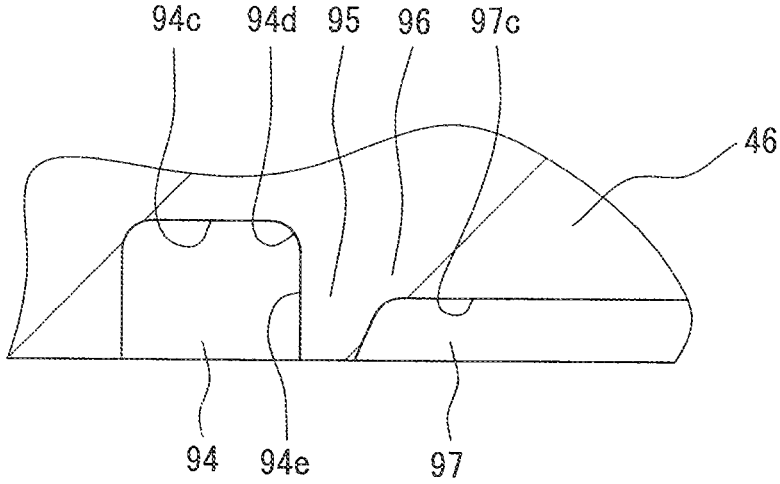
FIG. 6 is an enlarged view showing a part of the fuel injection device, indicated by the arrow VI in FIG. 4.

Next, the structure of the fuel injection device 100 will be further described in detail on the basis of FIG. 4 to FIG. 6.

An outflow depressed portion 97 and an inflow depressed portion 94 are formed in the orifice plate 46 of the control body 40. The outflow depressed portion 97 and the inflow depressed portion 94 are formed and defined by an outflow peripheral surface portion 97*a* and an inflow peripheral surface portion 94*a* provided at the opening wall surface 90, respectively. The outflow peripheral surface portion 97*a* and the inflow peripheral surface portion 94*a* are opposite to the pressing surface 73 in the displacement axis direction. A surface portion of the pressing surface 73 opposite to the outflow peripheral surface portion 97*a* in the axial direction is an outflow-opposite surface portion 97*b*, and a surface portion of the pressing surface 73 opposite to the inflow peripheral surface portion 97*b* in the axial direction is an inflow-opposite surface portion 94*b*. The outflow peripheral surface portion 97*a* is depressed to a side opposite to the outflow-opposite surface portion 97*b*, thereby defining and forming the outflow depressed portion 97. The inflow peripheral surface portion 94*a* is depressed to a side opposite to the inflow-opposite surface portion 94*b*, thereby defining and forming the inflow depressed portion 94. The inflow depressed portion 94 is recessed more deeply than the outflow depressed portion 97 in the displacement axis direction. For example, the depressed deep (i.e., depressed dimension) of the inflow depressed portion 94 in the displacement axis direction is in a range of 1.5 to 2.0 times with respect to the depressed deep (i.e., depressed dimension) of the outflow depressed portion 97. However, a ratio between the depressed deep of the inflow depressed portion 94 and the depressed deep of the outflow depressed portion 97 is not limited to the above range, and may be suitably changed.

The outflow depressed portion 97 is depressed in the shape of a circle in the central portion, in the radial direction of the opening wall surface 90. The inflow depressed portion 94 is provided at an outer peripheral side of the outflow depressed portion 97. The inflow depressed portion 94 is formed into a circular shape positioned coaxially with the circular pressing surface 73. In addition, the circular-shaped inflow depressed portion 94 is formed coaxially with the opening wall surface 90 and the outflow depressed portion 97. A circular partition portion 95 is formed in the orifice plate 46 to independently separate the outflow depressed portion 97 and the inflow depressed portion 94 from each other.

Because the depressed dimension of the outflow depressed portion 97 is smaller than the depressed dimension of the inflow depressed portion 94 in the axial direction, a bottom surface 94*c* of the inflow depressed portion 94 is shifted from a bottom surface 97*c* of the outflow depressed portion 97 in the axial direction, as shown in FIG. 4. Because the depressed dimensions of the inflow depressed portion 94 and the outflow depressed portion 97 are different from each other, a bottom wall portion 96 defining the bottom surface 97*c* of the outflow depressed portion 97 is placed at an inner peripheral side of the partition wall portion 95, as shown in FIGS. 4 and 6.

The inflow port 52*a* is open at the bottom surface 94*c* of the inflow depressed portion 94, such that the fuel from the inflow port 52*a* flows into the inflow depressed portion 94. Therefore, the fuel flowing from the inflow port 52*a* into the inflow depressed portion 94 flows in the inflow depressed portion 94 in a circumferential direction. In the present embodiment, a channel sectional area of the inflow depressed portion 94 is set larger than the half of the open area of the inflow port 52*a* opened into the inflow depressed portion 94. Here, the channel sectional area of the inflow depressed portion 94 is a sectional area in the radial direction of the circular inflow depressed portion 94.

Next, the operation for opening and closing the valve portion 50 and the effects of the partition wall portion 95 in the above-described fuel injection device 100 will be described with reference to FIGS. 1 to 6.

Before the outflow port 54*a* is made to communicate with the return channel 14*f*, the plate engagement portion 78 of the floating plate 70 is seated on the plate stopper portion 58*a* by the operation of the pressure control valve 80. When the operation of the pressure control valve 80 makes the outflow port 54*a* communicate with the return channel 14*f*, the fuel flows out of the pressure control chamber 53 through the outflow channel 54. Due to the decompression around the outflow port 54*a*, the floating plate 70 is drawn toward the opening wall surface 90, and thereby the plate engagement portion 78 displaces in the direction separating from the stopper portion 58*a*. When the pressing surface 73 of the floating plate 70 contacts and presses the opening wall surface 90, the communication between the inflow port 52*a* opened in the opening wall surface 90 and the pressure control chamber 53 is interrupted.

In this state, the fuel placed between the pressure receiving surface 77 and the pressure receiving surface 61 flows into the outflow depressed portion 97 via the flow restricting hole 71. The fuel in the outflow depressed portion 97 is discharged via the outflow port 54*a* and the outflow channel 54. Because the passage area of the throttle portion 71*a* of the flow restricting hole 71 is smaller than the open area of the outflow port 54*a*, the pressure in the outflow depressed portion 97 is reduced. Thus, the pressure of the fuel in the outflow depressed portion 97 becomes lower than the pressure of the fuel in the pressure control chamber 53.

On the other hand, the pressure in the inflow depressed portion 94 is increased by the supply fuel supplied via the inflow port 52*a*. Thus, the pressure of the fuel in the inflow depressed portion 94 becomes higher than the pressure of the fuel in the pressure control chamber 53. Because the fuel pressure is different between the inflow depressed portion 94 and the outflow depressed portion 97, a pressing force for pressing the partition wall portion 95 from a side of the inflow depressed portion 94 to the outflow depressed portion 97 is applied to the partition wall portion 95 that partitions the inflow depressed portion 94 and the outflow depressed portion 97 from each other. The partition wall portion 95 receives a pressing force from the pressing surface 73 of the floating plate 70.

When the fuel is continuously discharged from the pressure control chamber 53 via the flow restricting hole 71 and the outflow port 54*a*, the fuel pressure in the pressure control chamber 53 is reduced to a predetermined pressure. When the pressure in the pressure control chamber 53 is equal to or lower than the predetermined pressure, the nozzle needle 60 is moved upwardly toward the pressure control chamber 53, so that the seat portion 65 is separated from the valve seat portion 45 and the valve portion 50 is opened. Thereafter, the displacement of the nozzle needle 60 is regulated by using the abutting of the needle engagement portion 68 of the nozzle needle 60 to the needle stopper portion 58*b*. Thus, the maximum open degree of the valve portion 50 can be controlled.

When the communication between the outflow port 54*a* and the return channel 14*f* is interrupted by the pressure control valve 80, the floating plate 70 is pressed toward the pressure receiving portion 61 of the nozzle needle 60 by the fuel flowing from the inflow port 52*a*, and starts displacing. When the floating plate 70 is separated from the opening wall surface 90, the pressing force from the pressing surface 73 of the floating plate 70 to the partition wall portion 95 is released. In this case, the inflow depressed portion 94 and the outflow depressed portion 97 communicate with each other, and the pressure difference between the inflow depressed portion 94 and the outflow depressed portion 97 is not caused, thereby releasing the pressing force applied to the partition wall portion 59 due to the pressure difference.

By the separation of the floating plate 70 from the opening wall surface 90, the supply fuel flowing into the pressure control chamber 53 from the inflow port 52*a* and high-pressure supply fuel stored in the inflow depressed portion 94 flow into the space 53*a* of the pressure control chamber 53. The fuel flowing into the space 53*a* flows through the flow restricting hole 71 and the clearance between the outer peripheral wall surface 74 and the control wall surface portion 57, and then reaches to the back-pressure space 53*b*. By the pressure increase in the whole pressure control chamber 53 including the back pressure space 53*b*, the nozzle needle 60 is pressed toward the valve portion 50, so that the seat portion 65 of the nozzle needle 60 seats on the seat portion 65. In this state, the valve portion 50 becomes in a valve closing state.

As shown in FIG. 6, because the inflow depressed portion 94 and the outflow depressed portion 97 are provided in the control body 40 and are separated from each other by the partition wall portion 95, a stress is easily collected to an angle portion 94*d* by which the bottom surface 94*c* of the inflow depressed portion 94 and an inner peripheral wall surface 94*e* of the inflow depressed portion 94 are continuously connected to define the inflow depressed portion 94. The stress applied to the angle portion 94*d* becomes larger, as the depressed dimension of the inflow depressed portion 94 and the outflow depressed portion 97 becomes larger, that is, as the dimension of the partition wall portion 95 in the axial direction becomes larger.

According to the first embodiment, the depressed dimension of the inflow depressed portion 94 depressed from the opening wall surface 90 in the axial direction is larger than the depressed dimension of the outflow depressed portion 97 depressed from the opening wall surface 90 in the axial direction. Therefore, as shown in FIG. 6, the bottom wall portion 96 is formed at the inner peripheral side of the inflow depressed portion 94. Thus, the bottom wall portion 96 supports the partition wall portion 95 from a side of the inflow depressed portion 94 to a side of the outflow depressed portion 97, against the fuel pressure from the side of the outflow depressed portion 97 to the side of the inflow depressed portion 94. As a result, even when the depressed dimension of the inflow depressed portion 94 is large, the stress caused in the angle portion 94*d* due to the compression force applied to the partition wall portion 95 can be reduced. Thus, the strength of the partition wall portion 95 can be effectively increased, thereby increasing durability of the fuel injection device 100.

When the depressed dimension of the inflow depressed portion 94 is large, the amount of the supply fuel storable in the inflow depressed portion 94 can be made larger. In this case, the fuel amount discharged from the inflow depressed portion 94 to the pressure control chamber 53 can be increased, when the communication between the outflow port 54*a* and the return channel 14*f* is shut by the pressure control valve 80 thereby displacing the floating plate 70 in a direction opposite to the opening wall surface 90. Thus, the fuel pressure in the pressure control chamber 53 can be rapidly recovered, and thereby the nozzle needle 60 accurately closes the valve portion 50 in accordance with the fuel pressure in the pressure control chamber 53. As a result, the responsibility of the fuel injection device 100 can be improved.

Thereby, the durability of the fuel injection device 100 can be increased while the responsibility of the valve portion 50 can be improved.

In the present embodiment, the fuel flowing from the inflow port 52*a* into the inflow depressed portion 94 is separated into two parts in the circumferential direction of the circular inflow depressed portion 94, and flows in the circular inflow depressed portion 94. Because the channel sectional area of the inflow depressed portion 94 in a section perpendicular to the circumferential direction is larger than the half of the open area of the inflow port 52*a*, the separated two parts of the fuel respectively smoothly flow in the inflow depressed portion 94. Thus, the fuel flowing from the inflow port 52*a* can be rapidly supplied to the entire area in the inflow depressed portion 94. In this case, when the floating plate 70 is separated from the opening wall surface 90, the discharge of the supply fuel from the inflow depressed portion 94 to the pressure control chamber 53 can be accurately performed. As a result, the responsibility of the fuel injection device 100 can be more effectively improved.

As described above, in the present embodiment, a force is applied to the floating plate 70 to a side opposite to the opening wall surface 90 by the supply fuel discharged from the inflow depressed portion 94. The pressing surface 73 of the floating plate 70 is a circular shape and the inflow depressed portion 94 is a circular shape positioned coaxially with the pressing surface 73 of the floating plate 70. Thus, the force applied to the pressing surface 73 by the fuel discharged from the inflow depressed portion 94 can be applied to the pressing surface 73 in uniform in the circumferential direction of the pressing surface 73. Therefore, the floating plate 70 can be displaced reciprocally and smoothly in the pressure control chamber 53. Thus, the pressure recovery in the pressure control chamber 53 can be performed smoothly, thereby reducing the time for which the nozzle needle 60 closes the valve portion 50. As a result, the responsibility of the fuel injection device 100 can be further improved.

In the present embodiment, the inflow depressed portion 94 formed at the outer peripheral side of the outflow depressed portion 97 in the opening wall surface 90 is positioned closer to the outer periphery of the pressing surface 73 than the position of the outflow depressed portion 97. Because the inflow depressed portion 94 is positioned closer to the outer periphery of the pressing surface 73 than the position of the outflow depressed portion 97, the flow distance of the fuel discharged from the inflow depressed portion 94 to the space 53*a* of the pressure control chamber 53 and then reaching the back pressure space 53*b* can be made shorter. Thus, the flow time for which the fuel flows from the opening space 53*a* to the back pressure space 53*b* can be made shorter, and thereby the pressure recovery in the entire pressure control chamber 53 including the back pressure space 53*b* can be easily obtained. As a result, the valve portion 50 can be rapidly closed by the nozzle needle 60, and the responsibility of the fuel injection device 100 can be more effectively improved.

In the present embodiment, the inflow depressed portion 94 and the outflow depressed portion 97 are provided in the orifice plate 46 that can be easily formed as compared with floating plate 70. In this case, the inflow depressed portion 94 and the outflow depressed portion 97 can be more accurately and easily formed. As a result, the durability of the fuel injection device 100 can be more effectively maintained even when the inflow depressed portion 94 and the outflow depressed portion 97 are formed in the orifice plate 46.

In the first embodiment, the nozzle needle 60 is an example of a valve member, the floating plate 70 is an example of a pressing member, and the orifice plate 46 is an example of a channel forming member.

Second Embodiment

Figure 7:
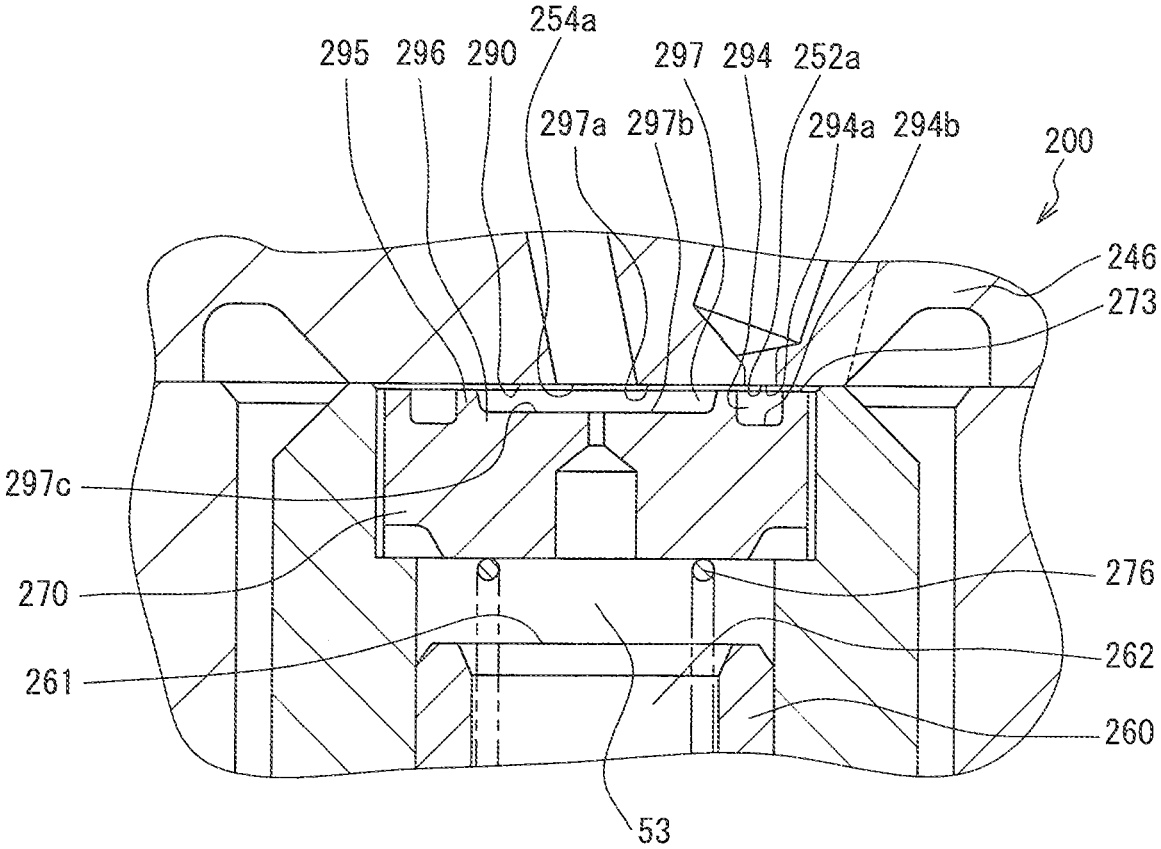
FIG. 7 is a view to show a modification example of FIG. 4, according to a second embodiment of the present invention.

A second embodiment of the present invention will be described with reference to FIG. 7. The second embodiment shown in FIG. 7 is a modification example of the above-described first embodiment. A fuel injection device 200 of the second embodiment includes a nozzle needle 260, an orifice plate 246 and a floating plate 270, which correspond to the nozzle needle 60, the orifice plate 46 and the floating plate 70 of the above-described first embodiment, respectively. In addition, in the fuel injection device 200, a plate spring 276 is provided to bias the floating plate 270 to the side of an opening wall surface 290 of the orifice plate 246. First, in the nozzle needle 260, a spring housing portion 262 is formed to house one end portion of the plate spring 276. The spring housing portion 262 is a cylindrical hole formed coaxially with the nozzle needle 260 in the central portion in the radial direction of the pressure receiving surface 261 of the nozzle needle 260.

According to the second embodiment, an inflow depressed portion 294 and an outflow depressed portion 297 are provided in the floating plate 270 to be opposite to the opening wall surface 290. Thus, the opening wall surface 290 of the orifice plate 246 can be formed in a flat surface without any depressed portion. Hereinafter, the construction of the fuel injection device 200 according to the second embodiment will be described in detail.

As described above, the outflow depressed portion 297 and the inflow depressed portion 294 are formed in the floating plate 270. The outflow depressed portion 297 is recessed in the axial direction from an outflow-opposite surface portion 297*b* of a pressing surface 273 of the floating plate 270 to a side opposite to an outflow peripheral surface 297*a* of the opening wall surface 290. The inflow depressed portion 294 is recessed in the axial direction from an inflow-opposite surface portion 294*b* of the pressing surface 273 of the floating plate 270 to a side opposite to an inflow peripheral surface 294*a* of the opening wall surface 290. The inflow depressed portion 294 is recessed from the pressing surface 273 more deeply than the outflow depressed portion 297 in the displacement axis direction.

The outflow depressed portion 297 is depressed in the shape of a circle in the central portion, in the radial direction of the pressing surface 273. The inflow depressed portion 294 is provided at an outer peripheral side of the outflow depressed portion 297. In addition, the inflow depressed portion 294 is formed into a circular shape coaxially with the circular pressing surface 273 and the outflow depressed portion 297. A circular partition portion 295 is formed in the floating plate 270 to independently separate the outflow depressed portion 297 and the inflow depressed portion 294 from each other. The partition wall portion 295 is supported from its inner peripheral side by a bottom wall portion 296 which forms a bottom surface 297*c* of the outflow depressed portion 297. The inflow port 252*a* is open in the inflow depressed portion 294, such that the fuel from the inflow port 252*a* flows into the inflow depressed portion 294. Therefore, the fuel flowing from the inflow port 252*a* into the inflow depressed portion 294 is separated into two parts in a circumferential direction. Even in the present embodiment, a channel sectional area of the inflow depressed portion 294 in a section perpendicular to the circumferential direction is set larger than the half of the open area of the inflow port 252*a* opened into the inflow depressed portion 294. In the fuel injection device 200, the other parts are similar to those of the fuel injection device 100 of the above-described first embodiment.

Next, the operation of the fuel injection device 200 will be described with reference to FIGS. 1 to 3 and 7.

In a state where the pressure control valve 80 interrupts communication between an outflow port 254*a* of an outflow channel and the return channel 14*f* (see FIG. 1), the pressing surface 273 of the floating plate 270 contacts the opening wall surface 290 by the biasing force of the plate spring 276 in the direction closing an inflow port 252*a* of an inflow channel. When the operation of the pressure control valve 80 makes the outflow port 254*a* communicate with the return channel 14*f*, the fuel flows out of the pressure control chamber 53 through the outflow channel. Due to the decompression around the outflow port 254*a*, the floating plate 270 is drawn toward the opening wall surface 290, and thereby the pressing surface 273 of the floating plate 270 presses the opening wall surface 290. In this case, the inflow port 252*a* is closed. When the discharge of the fuel in the pressure control chamber 53 is continuously performed, the fuel pressure in the pressure control chamber 53 is reduced. When the pressure in the pressure control chamber 53 is equal to or lower than a predetermined pressure, the nozzle needle 260 is moved upwardly toward the pressure control chamber 53, so that the seat portion 65 is separated from the valve seat portion 45 and the valve portion 50 is opened.

When the communication between the outflow port 254*a* and the return channel 14*f* is interrupted by the pressure control valve 80, the floating plate 270 is pressed toward the nozzle needle 260 by high-pressure fuel flowing from the inflow port 252*a*. When the force, due to the high-pressure fuel in the inflow depressed portion 297 applied toward the nozzle needle 260, is larger than the biasing force of the plate spring 276 acting in the direction toward the opening wall surface 290, the floating plate 270 starts displacement. In this case, the floating plate 270 is separated from the opening wall surface 290, so that the inlet port 252*a* communicates with the pressure control chamber 53. Thus, introduction of the high-pressure fuel introduced into the pressure control chamber 53 is started.

Therefore, the pressure in the pressure control chamber 53 is increased and returned by the fuel flowing into the pressure control chamber 53 from the inflow port 252*a*. Because of the pressure increase in the pressure control chamber 53, the nozzle needle 260 is pressed toward the valve portion 50. Then, the seat portion 65 of the nozzle needle 260 seats on the valve seat portion 45, so that the injection holes 44 are closed.

After the valve portion 50 becomes in the valve close state, fuel can continuously flow from a space between the floating plate 270 and the opening wall surface 290, to a space between the floating plate 270 and the nozzle needle 260. Thus, a pressure difference between two sides (i.e., the side of the opening wall surface 290 and the side of the nozzle needle 260) of the floating plate 270 can be gradually reduced. In accordance with this, when the biasing force of the plate spring 276 is larger than the force pushing the floating plate 270 toward the nozzle needle 260, the floating plate 270 starts the displacement toward the side of the opening wall surface 290. Then, the floating plate 270 returns to the abutting state, in which the pressing surface 273 of the floating plate 270 abuts on the opening wall surface 290.

In the present embodiment, the inflow depressed portion 294 and the outflow depressed portion 297 are provided in the floating plate 270. Even in this case, the pressing force, due to the pressure different between the inflow depressed portion 294 and the outflow depressed portion 297, is applied to a partition wall portion 295 that partitions the inflow depressed portion 294 and the outflow depressed portion 297 from each other. According to the present embodiment, the depressed dimension of the outflow depressed portion 297 is shorter than the depressed dimension of the inflow depressed portion 294. Thus, the partition wall portion 295 is supported by a bottom wall portion 296 from the inner peripheral side of the partition wall portion 296, thereby increasing the strength. Accordingly, the durability of the fuel injection device 200 can be increased.

Furthermore, because the depressed dimension of the inflow depressed portion 294 can be made large, the amount of the supply fuel storable in the inflow depressed portion 294 can be increased. Thus, when the floating plate 270 is separated from the opening wall surface 290, the amount of the supply fuel from the inflow depressed portion 294 to the pressure control chamber 53 can be increased. As a result, the fuel pressure in the pressure control chamber 53 can be rapidly recovered, and thereby the nozzle needle 260 accurately closes the valve portion 50 in accordance with the fuel pressure in the pressure control chamber 53. Thus, the responsibility of the fuel injection device 200 can be also improved.

Even in the second embodiment in which the inflow depressed portion 294 and the outflow depressed portion 297 are provided in the floating plate 270, the durability and the responsibility of the fuel injection device 200 can be improved by setting the depressed dimension of the inflow depressed portion 294 larger than the depressed dimension of the outflow depressed portion 297.

In the second embodiment, the floating plate 270 is an example of the pressing member. In the second embodiment, the other parts are similar to those of the above-described first embodiment.

Other Embodiments

Figure 8:
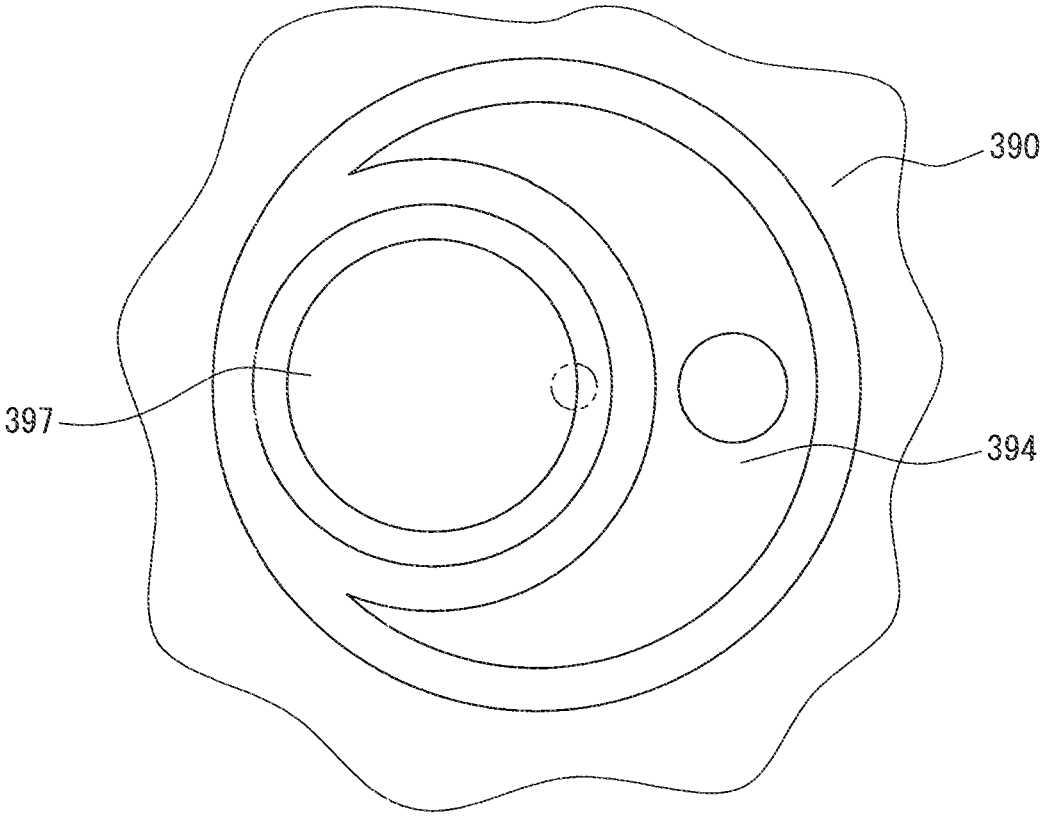
FIG. 8 is a view to show a modification example of FIG. 5, according to the other embodiment of the present invention.

In the above-described embodiments, the inflow depressed portion 94, 294 is formed in the orifice plate 46 or the floating plate 270 into a circular shape coaxially with the circular opening wall surface 90 or the circular pressing surface 273. Furthermore, the circular outflow depressed portion 97, 297 is provided at an inner peripheral side of the circular inflow depressed portion 94, 294. However, the shape and the arrangement of the inflow depressed portion 94, 294 and the outflow depressed portion 97, 297 are not limited to the examples described in the above embodiments. For example, an outflow depressed portion 397 and an inflow depressed portion 394 may be formed in a circular opening wall surface 390, as shown in FIG. 8. The outflow depressed portion 397 may be formed into a circular shape at a position shifted from the center of the opening wall surface 390. The inflow depressed portion 394 may be formed into a falcate shape along the outer periphery of the outflow depressed portion 397. Even when the inflow depressed portion 394 is formed into a shape without entirely enclosing the outer periphery of the outflow depressed portion 397, the depressed dimension of the inflow depressed portion 394 can be made larger than the depressed dimension of the outflow depressed portion 307. Even in this case, the durability and the responsibility of the fuel injection device can be improved. In the above-described embodiments and modifications thereof, the inflow depressed portion 94, 294, 394 is provided outside of the outflow depressed portion 97, 297, 397. However, the inflow depressed portion 94, 294, 394 may be provided inside of the outflow depressed portion 97, 297, 397. That is, the positions of the inflow depressed portion 94, 294, 394 and the outflow depressed portion 97, 297, 397 may be replaced from each other. Even in this case, the depressed dimension of the inflow depressed portion 94, 294, 394 can be made larger than the depressed dimension of the outflow depressed portion 97, 297, 397, thereby improving the durability and the responsibility of the fuel injection device.

In the above-described second embodiment, the inflow depressed portion 294 and the outflow depressed portion 297 are formed in the floating plate 270, and the floating plate 270 is biased to the side of the opening wall surface 290. However, the plate spring 276 may be removed similarly to the structure of the above-described first embodiment. Furthermore, in the structure of the first embodiment, the structure of the plate spring 276 may be used similarly to the structure of the above-described second embodiment.

In the present embodiments, the channel sectional area of the inflow depressed portion 94, 294 is set larger than the half of the open area of the inflow port 52*a*, 252*a* opened into the inflow depressed portion 94, 294. However, if the supply fuel can flow from the inflow port 52*a*, 252*a* to the inflow depressed portion 94, 294 without delay, the channel sectional area may be set equal to or smaller than the half of the open area of the inflow port 52*a*, 252*a*.

In the above-described embodiments, as the drive portion for opening and closing the pressure control valve 80, a mechanism for driving the movable member 35 by using the electromagnetic force of the solenoid 31 is adapted. However, the drive portion other than the solenoid 31, e.g., a piezoelectric element, may be adapted. Even in this case, the drive portion for opening and closing the pressure control valve 80 may be operated based on the control signal from the engine controller 17.

In the above embodiments, the present invention is applied to the fuel injection device used for the diesel engine 20 that injects fuel directly into the combustion chamber 22. However, the present invention may be applied to a fuel injection device for any internal combustion engine, without being limited to the diesel engine 20. In addition, the fuel injected by the fuel injection device is not limited to light oil but may be gasoline, liquefied petroleum gas, and like. In another addition, the present invention may be applied to a fuel injection device that injects fuel to a combustion chamber of an engine for burning fuel such as an external combustion engine.

Although the present invention has been fully described in connection with the preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A fuel injection device that opens and closes a valve portion for controlling an injection of supply fuel supplied from a supply channel and injected from a nozzle hole, and that discharges a portion of the supply fuel into a return channel based on the control, the fuel injection device comprising:

a control body having a pressure control chamber, into which the fuel flowing through the supply channel flows from an inflow port and from which the fuel is discharged to the return channel through an outflow port, and an opening wall surface exposed to the pressure control chamber and having the inflow port and the outflow port opened therein;

a pressure control valve configured to make communication between the outflow port and the return channel and to interrupt the communication, so as to control pressure of the fuel in the pressure control chamber;

a valve member configured to open and close the valve portion in response to the pressure of the fuel in the pressure control chamber; and a pressing member arranged to be reciprocally displaced in the pressure control chamber and having a pressing surface opposite to the opening wall surface, wherein the pressing surface of the pressing member presses the opening wall surface to interrupt communication between the inflow port and the pressure control chamber when the communication between the outflow port and the return channel is made by the pressure control valve, the pressing surface of the pressing member is displaced and separated from the opening wall surface to open the inflow port of the opening wall surface to the pressure control chamber when the communication between the outflow port and the return channel is interrupted by the pressure control valve, the opening wall surface has an outflow peripheral surface portion provided around the outflow port, and an inflow peripheral surface portion provided around the inflow port, the pressing surface of the pressing member is provided with an outflow-opposite surface portion opposite to the outflow peripheral surface portion in a displacement axis direction, and an inflow-opposite surface portion opposite to the inflow peripheral surface portion in the displacement axis direction, one of the outflow peripheral surface portion and the outflow-opposite surface portion of the opening wall surface and the pressing surface is provided with an outflow depressed portion with a depressed outflow bottom surface depressed in the displacement axis direction to a side opposite to the other one of the outflow peripheral surface portion and the outflow-opposite surface portion, one of the inflow peripheral surface portion and the inflow-opposite surface portion of the opening wall surface and the pressing surface, which is provided with the outflow depressed portion, is provided with an inflow depressed portion with a depressed inflow bottom surface depressed in the displacement axis direction to a side opposite to the other one of the inflow peripheral surface portion and the inflow-opposite surface portion, a depressed dimension of the inflow depressed portion is larger than a depressed dimension of the outflow depressed portion, in the displacement axis direction, the inflow port is open at the depressed inflow bottom surface of the inflow depressed portion, and the dimension of the inflow depressed portion in a radial direction of the pressing member is larger than a diameter of the inflow port.

2. The fuel injection device according to claim 1, wherein the pressing surface of the pressing member is a circular shape, and the inflow depressed portion is a circular shape provided coaxially with the pressing surface.

3. The fuel injection device according to claim 2, wherein the inflow depressed portion is provided such that the fuel flows in a circumferential direction, and a channel sectional area of the inflow depressed portion is larger than the half of an open area of the inflow port.

4. The fuel injection device according to claim 1, wherein the inflow depressed portion is provided at an outer peripheral side of the outflow depressed portion in the opening wall surface or the pressing surface.

5. The fuel injection device according to claim 1, wherein the control body includes a channel forming body that is provided with the opening wall surface and defines the pressure control chamber, and the inflow peripheral surface portion and the outflow peripheral surface portion define respectively the inflow depressed portion and the outflow depressed portion.

6. A fuel injection device that opens and closes a valve portion for controlling an injection of supply fuel supplied from a supply channel and injected from a nozzle hole, and that discharges a portion of the supply fuel into a return channel based on the control, the fuel injection device comprising:

a control body having a pressure control chamber, into which the fuel flowing through the supply channel flows from an inflow port and from which the fuel is discharged to the return channel through an outflow port, and an opening wall surface exposed to the pressure control chamber and having the inflow port and the outflow port opened therein;

a pressure control valve configured to make communication between the outflow port and the return channel and to interrupt the communication, so as to control pressure of the fuel in the pressure control chamber;

a valve member configured to open and close the valve portion in response to the pressure of the fuel in the pressure control chamber; and a pressing member arranged to be reciprocally displaced in the pressure control chamber and having a pressing surface opposite to the opening wall surface, wherein the pressing surface of the pressing member presses the opening wall surface to interrupt communication between the inflow port and the pressure control chamber when the communication between the outflow port and the return channel is made by the pressure control valve, the pressing surface of the pressing member is displaced and separated from the opening wall surface to open the inflow port of the opening wall surface to the pressure control chamber when the communication between the outflow port and the return channel is interrupted by the pressure control valve, one of the pressing surface of the pressing member and the opening wall surface of the control body is provided with an inflow depressed portion with a depressed inflow bottom surface and an outflow depressed portion with a depressed outflow bottom surface, which are respectively depressed in a displacement axis direction to a side opposite to the other one of the pressing surface of the pressing member and the opening wall surface of the control body, the outflow depressed portion is partitioned from the inflow depressed portion by a partition wall, the outflow port is provided in the outflow depressed portion and the inflow port is provided in the inflow depressed portion, a depressed dimension of the inflow depressed portion is larger than a depressed dimension of the outflow depressed portion, in the displacement axis direction, the inflow port is open at the depressed inflow bottom surface of the inflow depressed portion, and the dimension of the inflow depressed portion in a radial direction of the pressing member is larger than a diameter of the inflow port.

7. The fuel injection device according to claim 6, wherein the inflow depressed portion is a circular shape provided at an outer peripheral side of the outflow depressed portion coaxially with the outflow depressed portion.

8. The fuel injection device according to claim 6, wherein the inflow depressed portion is a shape provided along an outer peripheral side of the outflow depressed portion.

* * * * *